US009461362B2

(12) United States Patent
Lyu et al.

(10) Patent No.: US 9,461,362 B2
(45) Date of Patent: Oct. 4, 2016

(54) MULTI-BAND ANTENNA

(71) Applicants: UNIVERSAL SCIENTIFIC INDUSTRIAL (SHANGHAI) CO., LTD., Shanghai (CN); UNIVERSAL GLOBAL SCIENTIFIC INDUSTRIAL CO., LTD., Nantou County (TW)

(72) Inventors: Chao-An Lyu, Nantou County (TW); Jui-Chih Chien, Nantou County (TW); Hung-Wei Chiu, Nantou County (TW)

(73) Assignees: UNIVERSAL SCIENTIFIC INDUSTRIAL (SHANGHAI) CO., LTD., Shanghai (CN); UNIVERSAL GLOBAL SCIENTIFIC INDUSTRIAL CO., LTD., Nantou County (TW)

( * ) Notice: Subject to any disclaimer, the term of this patent is extended or adjusted under 35 U.S.C. 154(b) by 95 days.

(21) Appl. No.: 14/532,090

(22) Filed: Nov. 4, 2014

(65) Prior Publication Data

US 2015/0325915 A1 Nov. 12, 2015

(30) Foreign Application Priority Data

May 9, 2014 (TW) ..... 103116536 A

(51) Int. Cl.

| | |
|---|---|
| ***H01Q 1/38*** | (2006.01) |
| ***H01Q 5/371*** | (2015.01) |
| ***H01Q 7/00*** | (2006.01) |
| ***H01Q 9/04*** | (2006.01) |
| *H01Q 5/378* | (2015.01) |

(52) U.S. Cl.

CPC ..... *H01Q 5/371* (2015.01); *H01Q 7/00* (2013.01); *H01Q 9/0421* (2013.01); *H01Q 5/378* (2015.01)

(58) Field of Classification Search

CPC ..... H01Q 5/371; H01Q 7/00

USPC ..... 343/700 MS, 725, 726, 728, 729, 741, 343/842, 843, 866

See application file for complete search history.

(56) References Cited

U.S. PATENT DOCUMENTS

| | | | | |
|---|---|---|---|---|
| 6,573,869 | B2 * | 6/2003 | Moore | H01Q 1/243 343/700 MS |
| 6,864,841 | B2 | 3/2005 | Dai et al. | |
| 6,897,810 | B2 * | 5/2005 | Dai | H01Q 9/0421 343/700 MS |
| 7,352,326 | B2 * | 4/2008 | Korva | H01Q 1/243 343/700 MS |

(Continued)

FOREIGN PATENT DOCUMENTS

| | | |
|---|---|---|
| CN | 102484315 A | 5/2012 |
| TW | M439910 U1 | 10/2012 |

OTHER PUBLICATIONS

Taiwan Patent Office, Office action issued on Apr. 26, 2016.

*Primary Examiner* — Tho G Phan

(74) *Attorney, Agent, or Firm* — Li & Cai Intellectual Property (USA) Office

(57) ABSTRACT

A multi-band antenna and electronic device are provided. The multi-frequency antenna includes a feeding portion, a shorting portion, a radiating portion and a loop radiating portion. One end of the feeding portion is electrically connected to a signal source. One end of the shorting portion is electrically connected to a ground plane. The radiating portion is electrically connected to another end of the shorting portion and another end of the feeding portion. The loop radiating portion is electrically connected to the radiating portion.

8 Claims, 8 Drawing Sheets

(56) References Cited

U.S. PATENT DOCUMENTS 7,639,194 B2 * 12/2009 Chi ..... H01Q 1/38 343/702

8,482,464 B2 * 7/2013 Wong ..... H01Q 1/243 343/700 MS

2011/0043408 A1 * 2/2011 Shi ..... H01Q 9/0421 343/700 MS

* cited by examiner

MULTI-BAND ANTENNA

BACKGROUND

1. Technical Field

The present disclosure relates to a multi-band antenna, in particular, to a multi-band antenna comprising a loop radiating portion disposed in a feeding portion.

2. Description of Related Art

Please refer to FIG. 1, which shows a schematic diagram illustrating a conventional multi-band antenna. The conventional multi-band antenna 1 comprises a radiating portion 16, a feeding portion 14, a shorting portion 15 and a parasitic monopole antenna 17. The radiating portion 16, the feeding portion 14 and the shorting portion 15 form a planar inverted F antenna. The radiating portion 16 is electrically connected to one end of the shorting portion 15 and one end of the feeding portion 14. Another end of the feeding portion 14 is electrically connected to a signal resource 13. Another end of the shorting portion 15 is electrically connected to a ground plate 12. One end of the parasitic monopole antenna 17 is an open end, and another end of the parasitic monopole antenna 17 is electrically connected to a ground plate 12.

The radiating portion 16 is divided into a first radiating portion 161 and a second radiating portion 162 by a connection point 16*c* which the feeding portion 14 is coupled to the radiating portion 16. The first radiating portion 161 is defined by one end 16*a* of the radiating portion 16 to the connection point 16*c*. The second radiating portion 162 is defined by another end 16*b* of the radiating portion 16 to the connection point 16*c*. The first radiating portion 161 is longer than the second radiating portion 162. The signal resource 13 operatively outputs at least one signal to the feeding portion 14, such that the first radiating portion 161 and the second radiating portion 162 respectively stimulate electromagnetic radiation signals with a first resonant frequency and a second resonant frequency. In addition, the first radiating portion 161 and the feeding portion 14 surround the parasitic monopole antenna 17, such that the electromagnetic radiation signal with the first resonant frequency couples to the parasitic monopole antenna 17. Accordingly, the parasitic monopole antenna 17 stimulates an electromagnetic radiation signal with a third resonant frequency, wherein the third resonant frequency is different with the first resonant frequency.

The conventional multi-band antenna 1 can be disposed in existing mobile devices and provides a multi-band operation achieving current requirements. However, the conventional multi-band antenna 1 has a problem in that the parasitic monopole antenna 17 is influenced by metal elements surrounding it, such that a stability of the conventional multi-band antenna 1 is also influenced when the conventional multi-band antenna 1 transmits or receives signals.

SUMMARY

An exemplary embodiment of the present disclosure provides a multi-band antenna including a feeding portion, a shorting portion, a radiating portion and a loop radiating portion. One end of the feeding portion is electrically connected to a signal source. One end of the shorting portion is electrically connected to a ground plane. The radiating portion is electrically connected to another end of the shorting portion and another end of the feeding portion. The loop radiating portion is electrically connected to the feeding portion.

In accordance with an embodiment of the present disclosure, the radiating portion, the feeding portion and the shorting portion form a planar inverted F antenna, and the loop radiating portion forms a closed loop.

In accordance with an embodiment of the present disclosure, the radiating portion comprises a first radiating portion and a second radiating portion.

In accordance with an embodiment of the present disclosure, the first radiating portion is formed by a first end of the radiating portion to a connection point in which the feeding portion is coupled to the radiating portion; the second radiating portion is formed by a second end of the radiating portion to the connection point in which the feeding portion is coupled to the radiating portion, and a length of the second radiating portion is less than the first radiating portion.

In accordance with an embodiment of the present disclosure, a shape formed by the closed loop is one of a rectangle, a circle, a triangle, or an oval.

In accordance with an embodiment of the present disclosure, the first radiating portion, the second radiating portion and the loop radiating portion operatively determine a first resonant frequency, a second resonant frequency and a third resonant frequency respectively, wherein the second resonant frequency is greater than the first resonant frequency, and the third resonant frequency is between the first resonant frequency and the second resonant frequency.

In accordance with an embodiment of the present disclosure, a resonant path of the first radiating portion is formed by the first end of the radiating portion to the signal source, a resonant path of the second radiating portion is formed by the second end of the radiating portion to the signal source, and the resonant path of the loop radiating portion is formed by a perimeter of the loop radiating portion and a path between the loop radiating portion to the signal source.

To sum up, the present disclosure provides a multi-band antenna for achieving multi-band operation using limited space. Compared with the conventional multi-band antenna, the present disclosure improves performance such as bandwidth, radiation efficiency, or gain of the multi-band antenna.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
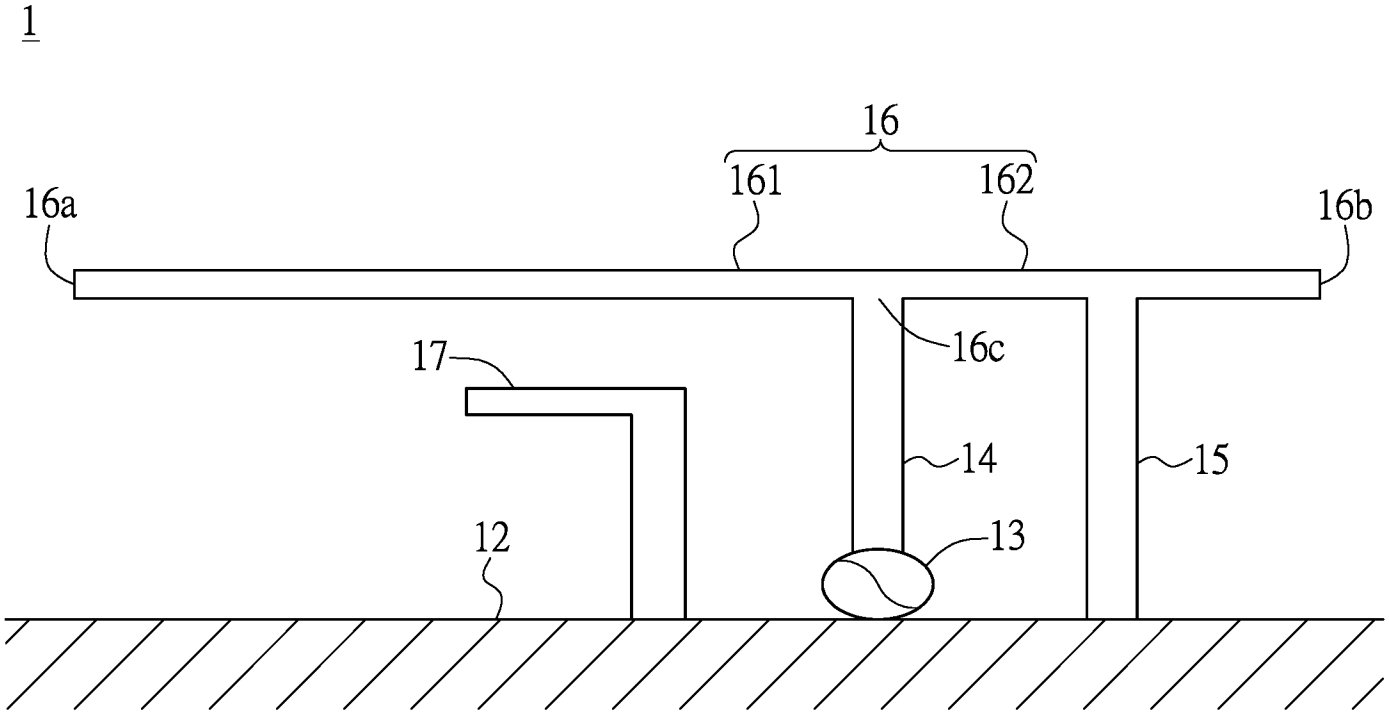
FIG.1 PRIOR ART
FIG. 1 is a schematic diagram illustrating a conventional multi-band antenna.

Reference will now be made in detail to the exemplary embodiments of the present disclosure, examples of which are illustrated in the accompanying drawings. Wherever possible, the same reference numbers are used in the drawings and the description to refer to the same or like parts.

[First Exemplary Embodiment]

Figure 2A:
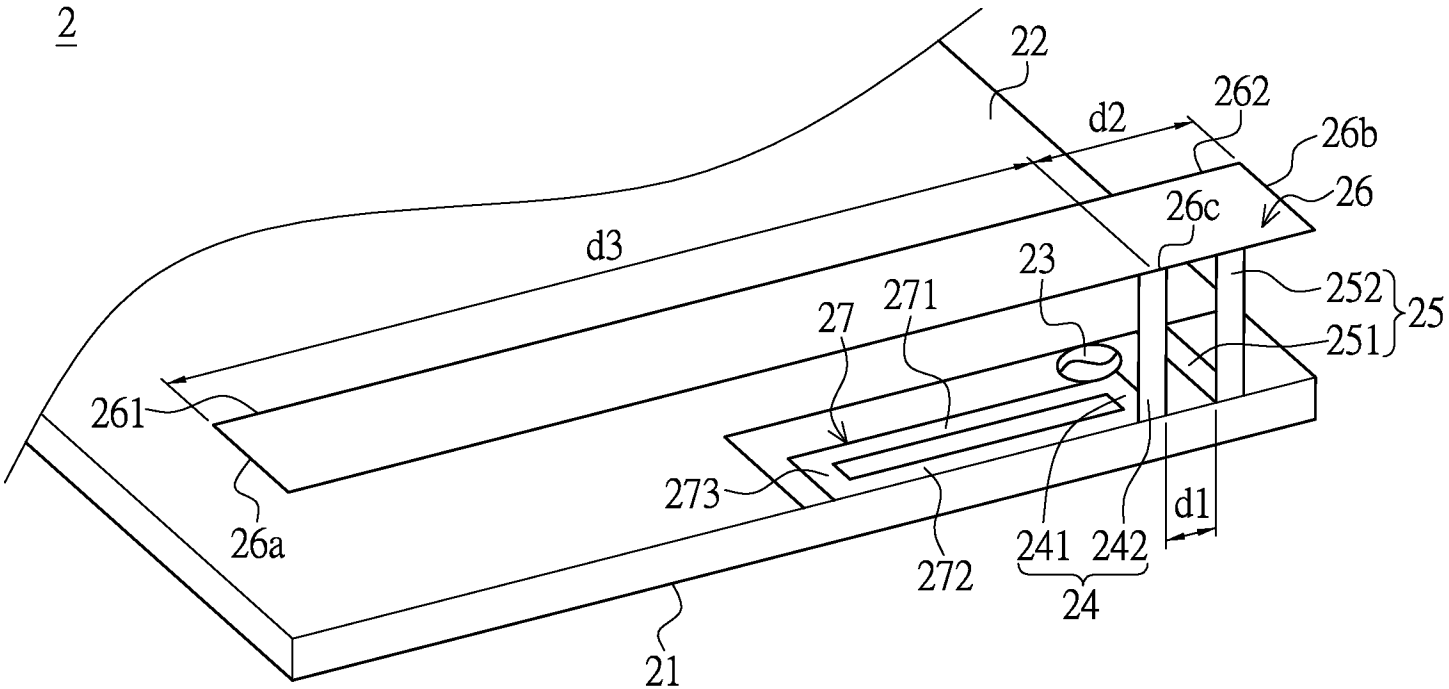
FIG. 2A is a schematic diagram illustrating a multi-band antenna in three-dimension provided in accordance with a first exemplary embodiment of the present disclosure.
Figure 2B:
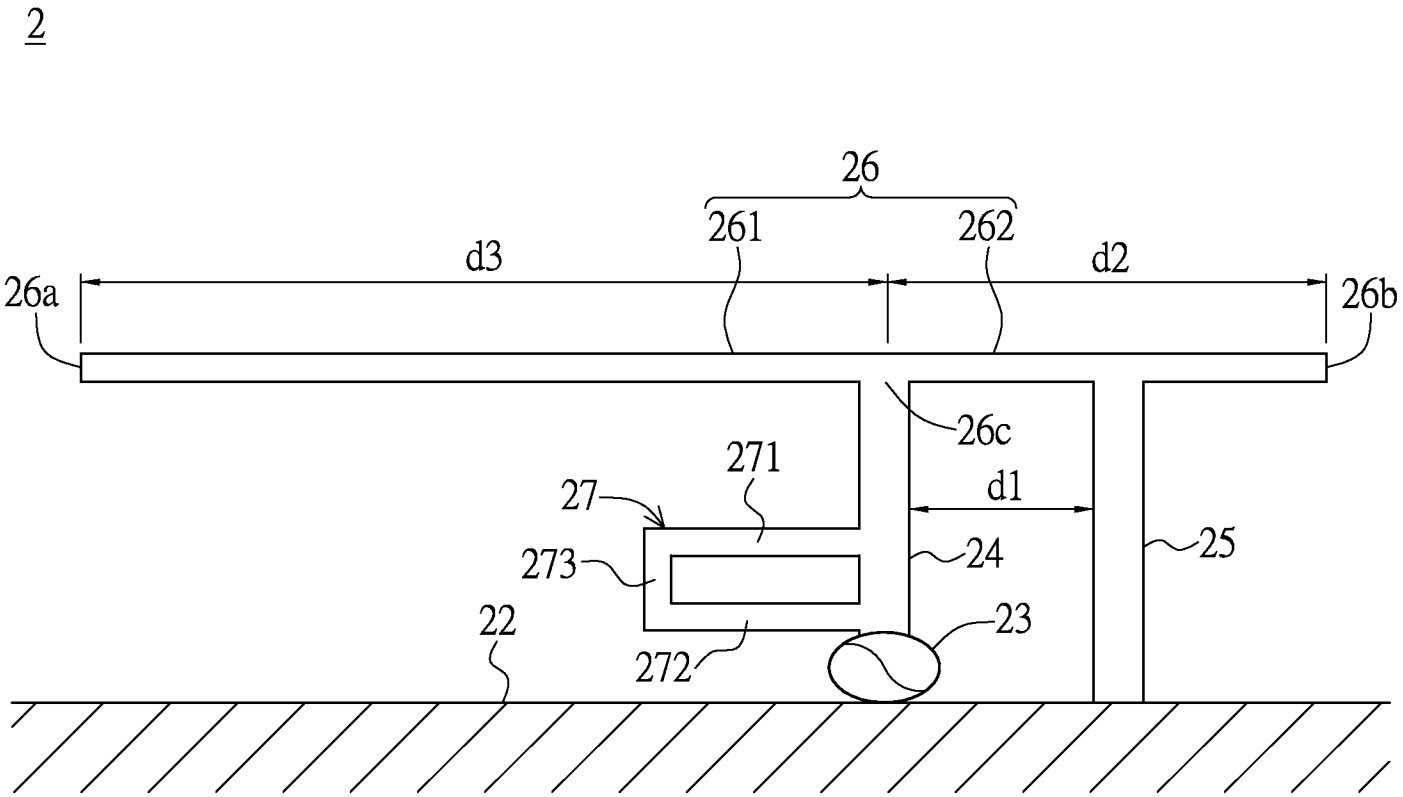
FIG. 2B is a schematic diagram illustrating the multi-band antenna provided in accordance with the first exemplary embodiment of the present disclosure.

Please refer to FIGS. 2A and 2B, FIG. 2A is a schematic diagram illustrating a multi-band antenna in three-dimensions provided in accordance with a first exemplary embodiment of the present disclosure, and FIG. 2B is a schematic diagram illustrating the multi-band antenna provided in accordance with the first exemplary embodiment of the present disclosure. A multi-band antenna 2 comprises a feeding portion 24, a shorting portion 25, a radiating portion 26 and a loop radiating portion 27. FIG. 2A shows the feeding portion 24, the shorting portion 25 and the loop radiating portion 27 are bent, such that a part of the feeding portion 24, a part of the shorting portion 25 and a part of the loop radiating portion 27 are disposed on a base plate 21. However, FIG. 2B does not show that the feeding portion 24, the shorting portion 25 and the loop radiating portion 27 are bent. Those skilled in the art will be able to infer that FIG. 2A shows a situation in which the multi-band antenna 2 is disposed in an electronic device and FIG. 2B shows a design concept of the multi-band antenna 2.

The radiating portion 26 is electrically connected to one end of the feeding portion 24 and one end of the shorting portion 25. Another end of the shorting portion 25 is electrically connected to a ground plane 22. Another end of the feeding portion 24 is electrically connected to a signal source 23. The feeding portion 24, the shorting portion 25 and the radiating portion 26 form a planar inverted F antenna.

The loop radiating portion 27 is electrically connected to the feeding portion 24 and forms a closed loop. The loop radiating portion 27 is configured to stimulate an electromagnetic radiation signal. The electromagnetic radiation signal which the loop radiating portion 27 stimulates has a different resonant frequency with the electromagnetic radiation signal which the radiating portion 26 stimulates. The loop radiating portion 27 is used to replace a parasitic monopole antenna disposed in a conventional multi-band antenna. It is worth noting that the loop radiating portion 27, is not similar to the parasitic monopole antenna, and is not easily influenced by metal elements surrounding it. Accordingly, performance such as bandwidth, radiation efficiency, or gain of the multi-band antenna 2 can be improved.

The multi-band antenna 2 is formed on one of surfaces of the base plate 21. The base plate 21 comprises the ground plane 22, wherein the ground plane 22 is a conductive metal layer. The base plate 21 may be a circuit board of the electronic device or an independent circuit board. In addition, the base plate 21 may be a single-layer structure, a two-layer structure, or a multi-layer structure.

In the exemplary embodiment, the loop radiating portion 27 is disposed on a rectangular metal sheet, and the loop radiating portion 27 contacts the signal source 23. However, the present disclosure does not limit whether the loop radiating portion 27 contacts the signal source 23. Furthermore, the present disclosure also does not limit a shape formed by the loop radiating portion 27 and the numbers of contacting points with which the loop radiating portion 27 contacts the signal source 23. It is worth noting that there is a distance d1 between the shorting portion 25 and the feeding portion 24. The distance d1 can be designed according to product specifications or actual requirements.

The signal source 23 operatively provides electromagnetic radiation signals to the multi-band antenna 2 through a transmitting line (not shown in FIGS. 2A and 2B) for wireless communication. The transmitting line may be a coaxial cable, which includes a metal cable (not shown in FIGS. 2A and 2B). The metal cable is electrically connected to the feeding portion 24. Hence, the electromagnetic radiation signals provided by the signal source 23 can be transmitted to the radiating portion 26 through the feeding portion 24, such that the radiating portion 26 transmits the electromagnetic radiation signals out of the multi-band antenna 2.

The radiating portion 26 is a metal plate and the radiating portion 26 is disposed upon the ground plate 22, wherein a shape of the metal plate is a rectangle. The radiating portion 26 is divided into a first radiating portion 261 and a second radiating portion 262 by a connection point 26*c* which the feeding portion 24 is coupled to the radiating portion 26. That is to say, the first radiating portion 261 is defined by a distance d3 which the distance d3 is between a first end 26*a* of the radiating portion 26 and the connection point 26*c*. The second radiating portion 262 is defined by a distance d2 which is between a second end 26*b* of the radiating portion 26 and the connection point 26*c*. The distance d3 of the first radiating portion 261 is longer than the distance d2 of the second radiating portion 262.

Moreover, the present disclosure does not limit the shape of the radiating portion 26. In another exemplary embodiment, the shape of the radiating portion 26 also can be a circle or an oval. Besides, those skilled in the art also can adjust lengths of the distance d2 and the distance d3, or adjust the relative position of the first radiating portion 261 and the second radiating portion 262. However, the present disclosure is not limited thereto.

The feeding portion 24 includes a first conducting line 241 and a first conducting pillar 242, wherein the first conducting line 241 is disposed on the base plate 21. Two ends of the first conducting line 241 are electrically connected to the signal source 23 and the first conducting pillar 242 respectively. In addition, the first conducting line 241 forms a first angle with the first conducting pillar 242, and the first angle, for example, may be 90 degree. However, those skilled in the art can design the first angle according to actual situations. The present disclosure does not limit a structure of the feeding portion 24.

The shorting portion 25 includes a second conducting line 251 and a second conducting pillar 252, wherein the second conducting line 251 is disposed on the base plate 21. Two ends of the second conducting line 251 are electrically connected to the ground plate 22 and the second conducting pillar 252 respectively. In addition, the second conducting line 251 forms a second angle with the second conducting pillar 252, and the second angle, for example, may be 90 degrees. However, those skilled in the art can design the second angle according to actual situations. The present disclosure does not limit a structure of the shorting portion 25.

The loop radiating portion 27 is disposed on the base plate 21. The loop radiating portion 27 overlaps a planar projection of the radiating portion 26, and the loop radiating portion 27 separates from the radiating portion 26 and the ground plate 22. In addition, the loop radiating portion 27 includes a first long section 271, a second long section 272 and a short section 273, wherein the first long section 271 and the second long section 272 separate from each other. One end of the first long section 271 is electrically connected to the signal source 23 and the first conducting line 241. Another end of the first long section 271 is electrically connected to one end of the short section 273. One end of the second long section 272 is electrically connected to the first conducting pillar 242 and the first conducting line 241. Another end of the second long section 272 is electrically connected to another end of the short section 273. In other words, the loop radiating portion 27 forms a rectangular path metal sheet by the first long section 271, the second long section 272 and the short section 273.

Furthermore, the loop radiating portion 27 is electrically connected to the feeding portion 24 to form a closed loop. However, a shape of the closed loop may be a circle, a triangle or an oval. In brief, the present disclosure is not limited thereto.

In the exemplary embodiment, the feeding portion 24, the shorting portion 25 and the loop radiating portion 27 have the same line width. However, in another exemplary embodiment, line widths of the feeding portion 24, the shorting portion 25 and the loop radiating portion 27 may be different from each other. In brief, the present disclosure is not limited thereto.

On the other hand, according to the above description, the multi-band antenna can provide three resonant frequencies to transmit and receive the electromagnetic radiation signals. The first radiating portion 261, the second radiating portion 262 and the loop radiating portion 27 respectively stimulate the electromagnetic radiation signals with a first resonant frequency, a second resonant frequency and a third resonant frequency. The second resonant frequency is greater than the first resonant frequency, and the third resonant frequency is between the first resonant frequency and the second resonant frequency. For example, the first resonant frequency is 900 MHz, the second resonant frequency is 2100 MHz, and the third resonant frequency is 1800 MHz.

Moreover, a resonant path of the first radiating portion 261 is formed by the first end of the radiating portion 26*a* to the signal source 23. A resonant path of the second radiating portion 262 is formed by the second end 26*b* of the radiating portion 26 to the signal source 23. A resonant path of the loop radiating portion 27 is formed by a perimeter of the loop radiating portion 27. The resonant paths of the first radiating portion 261, the second radiating portion 262 and the loop radiating portion 27 respectively determine the first resonant frequency, the second resonant frequency and the third resonant frequency. To put it concretely, the resonant path of the first radiating portion 261 closely approximates a quarter wavelength of the first resonant frequency. The resonant path of the second radiating portion 262 closely approximates a quarter wavelength of the second resonant frequency. The resonant path of the loop radiating portion closely approximates a half wavelength of the third resonant frequency.

Furthermore, in the exemplary embodiment, FIGS. 2A and 2B illustrate a structure of the multi-band antenna 2 formed by the feeding portion 24, the shorting portion 25 and the loop radiating portion 27. However, the structure of the multi-band antenna 2 should not be limited to examples provided herein. For example, those skilled in the art should be able to design the line widths and the shapes of the feeding portion 24, the shorting portion 25, the radiating portion 26 and the loop radiating portion 27 of the multi-band antenna 2 in response to actual requirements.

Besides, the lengths of the feeding portion 24, the shorting portion 25, the first radiating portion 261, the second radiating portion 262 and the loop radiating portion 27 are not limited to the examples provided by the instant embodiment. For achieving actual requirements, the feeding portion 24, the shorting portion 25, the radiating portion 26 and the loop radiating portion 27 can be designed to adjust the first resonant frequency, the second resonant frequency and the third resonant frequency. However, the present disclosure is not limited thereto.

Figure 3:
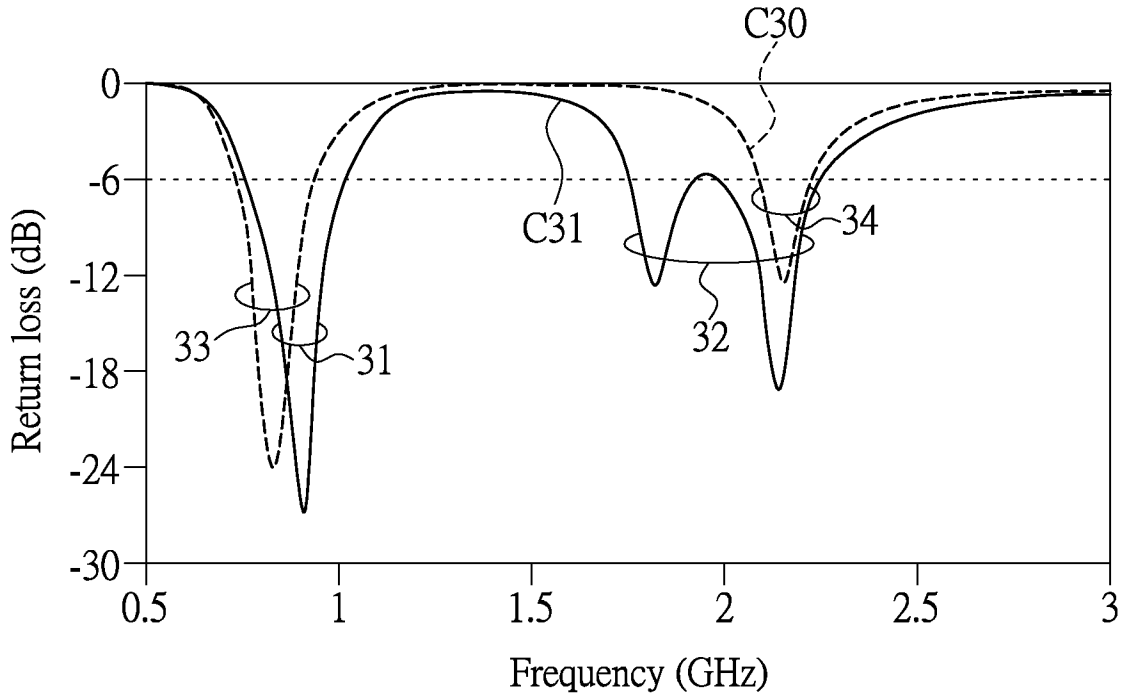
FIG. 3 is a waveform illustrating a return loss of the multi-band antenna and a return loss of a planar inverted F antenna without a loop radiating portion.

Next, please refer to FIG. 3, which shows a waveform illustrating a return loss of the multi-band antenna shown by FIG. 2A, 2B and a return loss of a planar inverted F antenna without a loop radiating portion. In FIG. 3, the vertical axis represents the return loss in dB, and the transverse axis represents frequency in GHz. A curve C30 represents measuring results of the planar inverted F antenna without the loop radiating portion 27. A curve C31 represents measuring results of the multi-band antenna 2 shown by FIG. 2A, 2B of the exemplary embodiment of the present disclosure.

Based upon FIG. 3, a radiation efficiency provided by the multi-band antenna 2 of the present disclosure in low-frequency band 31 is higher than the radiation efficiency provided by the planar inverted F antenna without the loop radiating portion 27 in low-frequency band 33. On the other hand, the radiation efficiency provided by the multi-band antenna 2 of the present disclosure in high-frequency band 32 is also higher than the radiation efficiency provided by the planar inverted F antenna without the loop radiating portion 27 in high-frequency band 34.

Based upon the above descriptions, the multi-band antenna 2 of the present disclosure can provide a multi-band service such as the first resonant frequency (in 900 MHz), the second resonant frequency (in 2100 MHz) and the third resonant frequency (in 1800 MHz). Furthermore, comparing with the planar inverted F antenna without the loop radiating portion 27, the multi-band antenna 2 of the present disclosure provides higher performance such as radiation efficiency and radiation stability.

[Second Exemplary Embodiment]

Figure 4A:
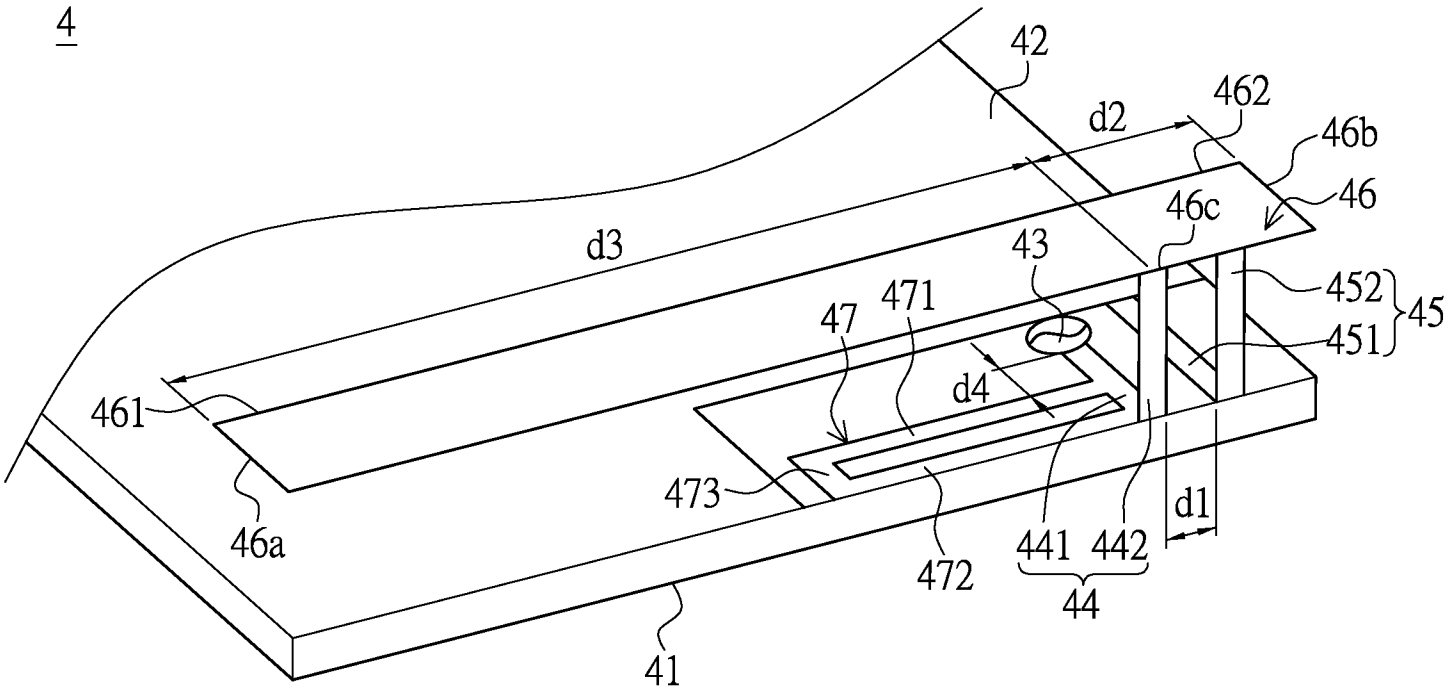
FIG. 4A is a schematic diagram illustrating a multi-band antenna in three-dimension provided in accordance with a second exemplary embodiment of the present disclosure.
Figure 4B:
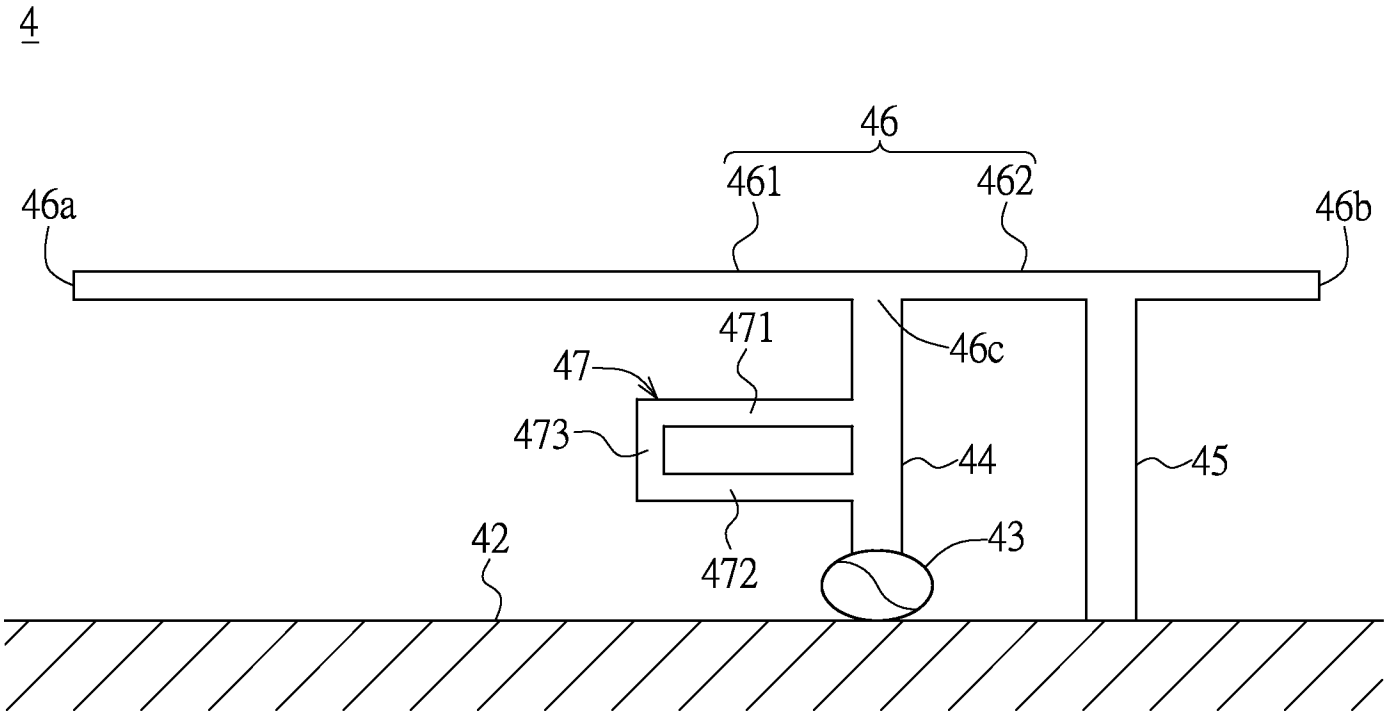
FIG. 4B is a schematic diagram illustrating the multi-band antenna provided in accordance with another exemplary embodiment of the second present disclosure.

Please refer to FIGS. 4A and 4B, FIG. 4A is a schematic diagram illustrating a multi-band antenna in three-dimension provided in accordance with a second exemplary embodiment of the present disclosure, and FIG. 4B is a schematic diagram illustrating the multi-band antenna provided in accordance with the second exemplary embodiment of the present disclosure. The multi-band antenna 4 of second exemplary embodiment is similar to the multi-band antenna 2 described previously. To put it concretely, a base plate 41, a ground plate 42, a signal source 43, a feeding portion 44 (comprising a first conducting line 441 and a first conducting pillar 442), a shorting portion 45 (comprising a second conducting line 451 and a second conducting pillar 452) and a radiating portion 46 (comprising ends 46*a*-46*b*, a connection point 46*c*, a first radiating portion 461 and a second radiating portion 462) shown by the second exemplary embodiment are respectively similar to a base plate 21, a ground plate 22, a signal source 23, a feeding portion 24 (comprising a first conducting line 241 and a first conducting pillar 242), a shorting portion 25 (comprising a second conducting line 251 and a second conducting pillar 252) and a radiating portion 26 (comprising ends 26*a*-26*b*, a connection point 26*c*, a first radiating portion 261 and a second radiating portion 262) shown by the first exemplary embodiment, FIGS. 2A and 2B. Hence, further descriptions are hereby omitted. Similar to a multi-band antenna 2 shown by the first exemplary embodiment, the multi-band antenna 4 also can provide a multi-band service such as the first resonant frequency (in 900 MHz), the second resonant frequency (in 2100 MHz) and the third resonant frequency (in 1800 MHz).

The differences between the multi-band antenna 4 and the multi-band antenna 2 is that a first long section 471 of a loop radiating portion 47 shown by FIG. 4A is not electrically connected to the signal source 43. In addition, there is a distance d4 between the first long section 471 and the signal source 43. In other words, the loop radiating portion 47 does not contact the signal source 43. It is worth noting that there are two contacting points at which the loop radiating portion 47 contacts the feeding portion 44. Thus, a resonant path of the loop radiating portion 47 is formed by a perimeter of the loop radiating portion 47 and the distance d4 which is between the loop radiating portion 47 to the signal source 43. Moreover, a second long section 472 and a short section 473 shown by FIG. 4A are similar to a second long section 272 and a short section 273 shown by FIGS. 2A and 2B, hence further descriptions are hereby omitted.

Incidentally, in the second exemplary embodiment, those skilled in the art can design the distance d4 between the first long section 471 and the signal source 43 in response to actual requirements. However, a structure of the multi-band antenna 4 is not limited to the examples provided by the instant embodiment.

[Third and Fourth Exemplary Embodiment]

Figure 5:
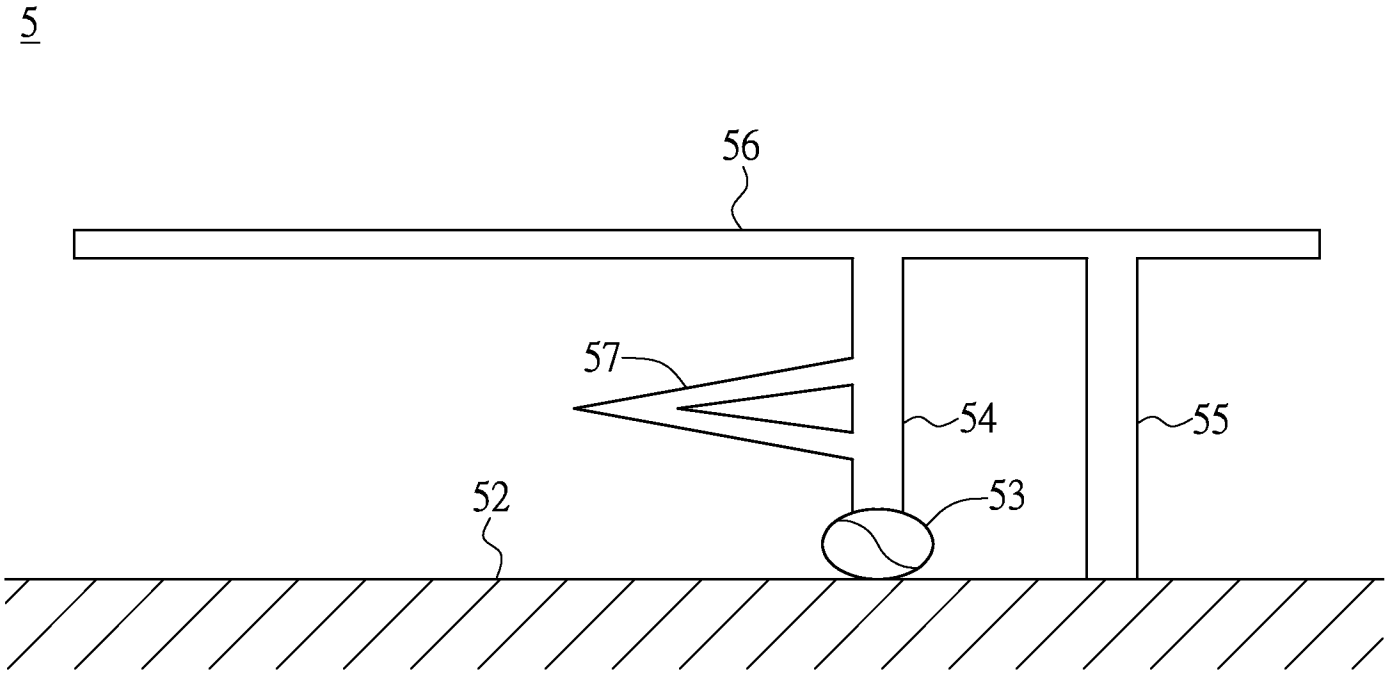
FIG. 5 is a schematic diagram illustrating the multi-band antenna provided in accordance with a third exemplary embodiment of the present disclosure.
Figure 6:
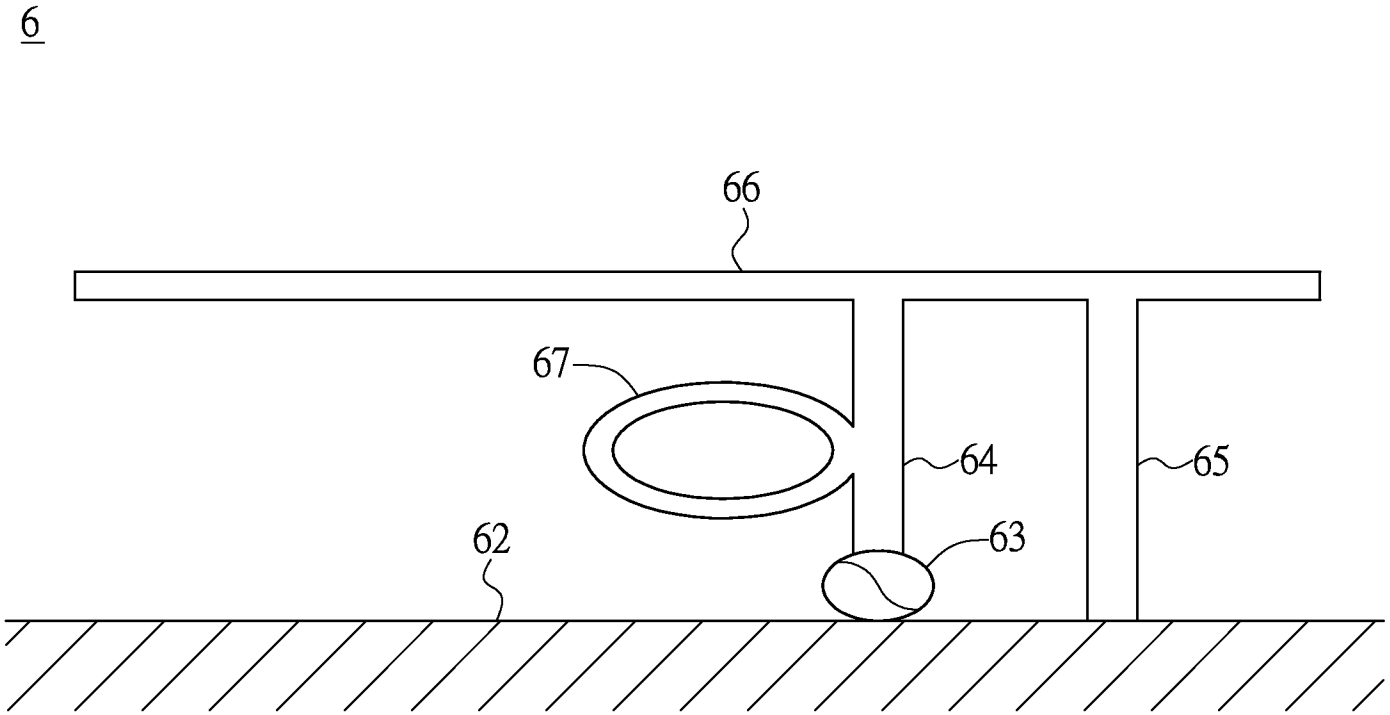
FIG. 6 is a schematic diagram illustrating the multi-band antenna provided in accordance with a fourth exemplary embodiment of the present disclosure.

Please refer to FIG. 5 and FIG. 6, FIG. 5 is a schematic diagram illustrating the multi-band antenna provided in accordance with a third exemplary embodiment of the present disclosure, and FIG. 6 is a schematic diagram illustrating the multi-band antenna provided in accordance with a fourth exemplary embodiment of the present disclosure. Comparing with a multi-band antenna 4 shown by FIGS. 4A and 4B, a loop radiating portion 57 of a multi-band antenna 5 shown by FIG. 5 is a triangle, and a loop radiating portion 67 of a multi-band antenna 6 shown by FIG. 6 is an oval. In FIG. 5, a ground plate 52, a signal source 53, a feeding portion 54, a shorting portion 55 and a radiating portion 56 are respectively similar to a ground plate 42, a signal source 43, a feeding portion 44, a shorting portion 45 and a radiating portion 46 shown by the second exemplary embodiment, FIGS. 4A and 4B. Similarly, in FIG. 6, a ground plate 62, a signal source 63, a feeding portion 64, a shorting portion 65 and a radiating portion 66 are respectively similar to a ground plate 42, a signal source 43, a feeding portion 44, a shorting portion 45 and a radiating portion 46 shown by the second exemplary embodiment, FIGS. 4A and 4B, and further descriptions are therefore omitted.

In FIG. 5, a resonant path of the loop radiating portion 57 is formed by a perimeter of the loop radiating portion 57 and the distance between the loop radiating portion 57 to the signal source 53. In FIG. 6, a resonant path of the loop radiating portion 67 is formed by a perimeter of the loop radiating portion 67 and the distance between the loop radiating portion 67 to the signal source 63.

[Possible Result of Exemplary Embodiment]

To sum up, comparing with a conventional multi-band antenna, a multi-band antenna provided by the present disclosure can avoid influences from other objects surrounding the multi-band antenna, such that the performance of the multi-band antenna is improved when the multi-band antenna transmits or receives signals. Concurrently, the multi-band antenna provided by the present disclosure has simple structure, such that the multi-band antenna is easy to manufacture. Furthermore, a size of the multi-band antenna is smaller than the conventional multi-band antenna. Accordingly, spaces used to configure the multi-band antenna are substantially reduced. In other words, the multi-band antenna provided by the present disclosure can be easily configured in various electronic devices increasing flexibility of configurations of the electronic devices.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A multi-band antenna, comprising:

a feeding portion, one end of the feeding portion electrically connected to a signal source;

a shorting portion, one end of the shorting portion electrically connected to a ground plane;

a radiating portion, electrically connected to another end of the shorting portion and another end of the feeding portion, wherein the radiating portion comprises a first radiating portion and a second radiating portion; and a loop radiating portion, electrically connected to the feeding portion, wherein the first radiating portion, the second radiating portion and the loop radiating portion operatively determine a first resonant frequency, a second resonant frequency and a third resonant frequency respectively.

2. The multi-band antenna according to claim 1, wherein the radiating portion, the feeding portion and the shorting portion form a planar inverted F antenna, and the loop radiating portion forms a closed loop.

3. The multi-band antenna according to claim 2, wherein a shape formed by the closed loop is one of a rectangle, a circle, a triangle, or an oval.

4. The multi-band antenna according to claim 1, wherein the first radiating portion is formed by a first end of the radiating portion to a connection point in which the feeding portion is coupled to the radiating portion; the second radiating portion is formed by a second end of the radiating portion to the connection point in which the feeding portion is coupled to the radiating portion, and a length of the second radiating portion is less than the first radiating portion.

5. The multi-band antenna according to claim 1, wherein the second resonant frequency is greater than the first resonant frequency, and the third resonant frequency is between the first resonant frequency and the second resonant frequency.

6. The multi-band antenna according to claim 5, wherein a resonant path of the first radiating portion is formed by the first end of the radiating portion to the signal source, a resonant path of the second radiating portion is formed by the second end of the radiating portion to the signal source, and a resonant path of the loop radiating portion is formed by a perimeter of the loop radiating portion and a path between the loop radiating portion to the signal source.

7. The multi-band antenna according to claim 6, wherein the resonant path of the first radiating portion closely approximates a quarter wavelength of the first resonant frequency, the resonant path of the second radiating portion closely approximates a quarter wavelength of the second resonant frequency, and the resonant path of the loop radiating portion closely approximates a half wavelength of the third resonant frequency.

8. The multi-band antenna according to claim 7, wherein the first resonant frequency is 900 MHz, the second resonant frequency is 2100 MHz, and the third resonant frequency is 1800 MHz.

* * * * *